US006644610B1

(12) United States Patent
Petrenko

(10) Patent No.: US 6,644,610 B1
(45) Date of Patent: Nov. 11, 2003

(54) BRACKET FOR SUN SHADE AND ASSEMBLY USING IT

(76) Inventor: Leonid Petrenko, 22728 N. Adkison Dr., Sun City West, AZ (US) 85375

( * ) Notice: Subject to any disclaimer, the term of this patent is extended or adjusted under 35 U.S.C. 154(b) by 0 days.

(21) Appl. No.: 10/064,617

(22) Filed: Jul. 31, 2002

Related U.S. Application Data

(60) Provisional application No. 60/384,346, filed on May 29, 2002.

(51) Int. Cl.[7] ..... A47H 1/142; A47H 5/14

(52) U.S. Cl. ..... 248/267; 160/243

(58) Field of Search ..... 248/252, 253, 248/254, 255, 266, 267, 268; 160/243, 903, 133

(56) References Cited

U.S. PATENT DOCUMENTS

| | | | | | |
|---|---|---|---|---|---|
| 89,126 | A | * | 4/1869 | Cheney | 160/243 |
| 164,244 | A | * | 6/1875 | Converse | 160/243 |
| 337,043 | A | * | 3/1886 | Baker | 160/370 |
| 1,130,848 | A | * | 3/1915 | Seward | 248/255 |
| 1,248,320 | A | * | 11/1917 | Hamilton | 248/254 |
| 1,520,066 | A | * | 12/1924 | Mahoney | 248/254 |
| 1,559,124 | A | * | 10/1925 | Newton | 248/254 |
| 2,029,308 | A | * | 2/1936 | Causey | 160/38 |
| 2,336,899 | A | * | 12/1943 | Stern | 160/243 |
| 2,350,085 | A | * | 5/1944 | Yashan | 160/293.1 |
| 2,808,222 | A | * | 10/1957 | Wassyng et al. | 248/262 |
| 3,173,643 | A | * | 3/1965 | Rath | 248/222.41 |
| 5,785,105 | A | * | 7/1998 | Crider et al. | 160/243 |
| 5,857,653 | A | * | 1/1999 | Dujlovich | 248/267 |
| 5,913,564 | A | * | 6/1999 | Stewart et al. | 296/172 |
| 6,322,029 | B1 | | 11/2001 | Sonnenberg et al. | 248/222.13 |

FOREIGN PATENT DOCUMENTS

| | | | | |
|---|---|---|---|---|
| GB | 577764 | * | 5/1946 | 248/267 |

* cited by examiner

*Primary Examiner*—Ramon O. Ramirez
*Assistant Examiner*—Jon Szumny
(74) *Attorney, Agent, or Firm*—Richard D. Fuerle

(57) ABSTRACT

A bracket can be attached to a vertical wall so that it extends out from said wall. The bracket can hold a fixed rod to which is attached a shade. A second rod can be attached to the bottom of the shade. Cords pass over the bottom of the shade and through the brackets. Pulling on the cords raises the shade and releasing the cords lowers the shade.

20 Claims, 6 Drawing Sheets

BRACKET FOR SUN SHADE AND ASSEMBLY USING IT

This application claims the benefit of U.S. Provisional Application No. 60/384,346, filed May 29, 2002.

BACKGROUND OF INVENTION

This invention relates to a bracket for holding a sun shade and to an assembly of the bracket and the shade. In particular, it relates to brackets for holding a rod on which a shade is secured that can be rolled up and to the a shade assembly of the bracket, a shade, and cords.

A great many patents have issued directed to brackets for supporting window shade rods. Many of these brackets have a complicated structure and require clamps, bolts, and pulleys to install. Often they are not sufficiently durable for outdoor use and cannot be easily taken down when the seasons change.

SUMMARY OF INVENTION

The brackets of this invention have a simple structure with no moving parts other than possibly a roller, which performs the function of a pulley by holding the cord used to set the height of the shade. Because of their simple structure, they are less subject to wear and weathering and can function outside for many years without failure. The brackets can be mounted and de-mounted quickly and easily without removing any screws, so that they can be taken in or put out, depending upon the season of the year, in a few minutes. They are inexpensive to make and can be used with a wide variety of different types of shades.

DETAILED DESCRIPTION

Figure 1:
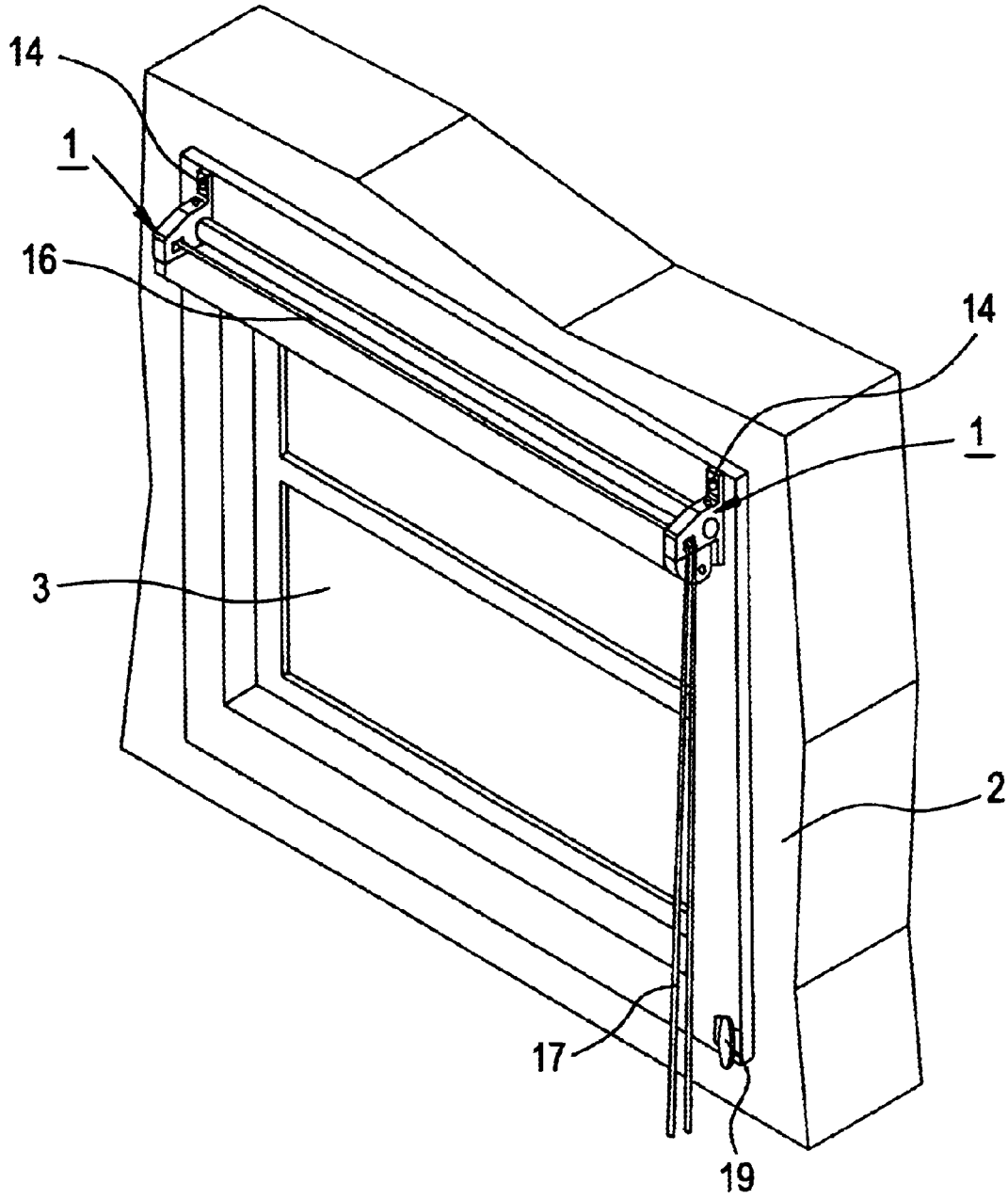
FIG. 1 is an isometric view showing a certain presently preferred embodiment of a shade assembly according to this invention with the shade rolled up.

Referring to FIGS. 1, 2, 3, 4, and 5, brackets 1 are mounted on wall 2 at the same height on either side and near the top of window 3. Brackets 1 support round fixed rod 4, which is inserted into an overlapped portion 5 of shade 6.

Figure 5:
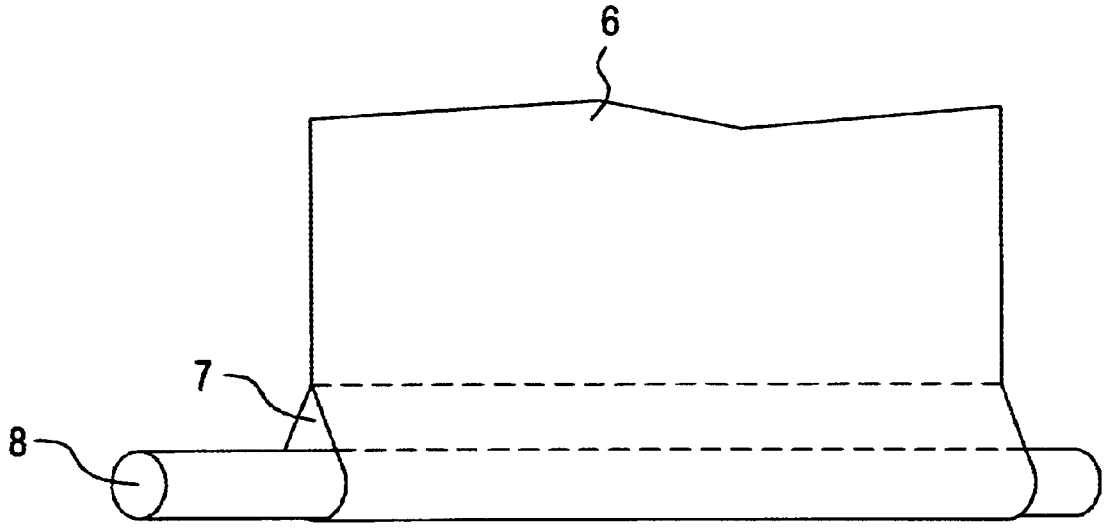
FIG. 5 is an isometric view showing the bottom portion of the shade shown in FIG. 1.

Referring to FIG. 5, the bottom of shade 6 also has an overlapped portion 7, which holds a second round rod 8.

Figure 2:
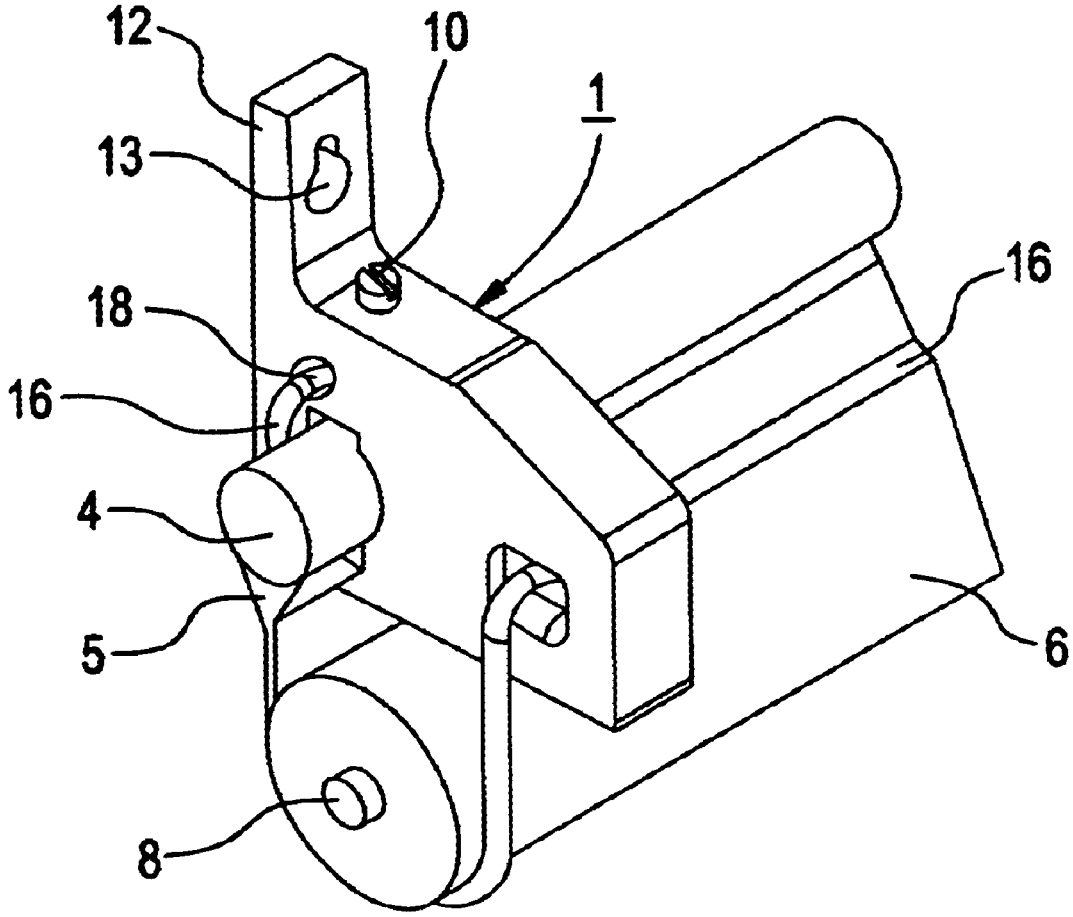
FIG. 2 is a partially cut away isometric view showing the left portion of the shade assembly of FIG. 1.
Figure 3:
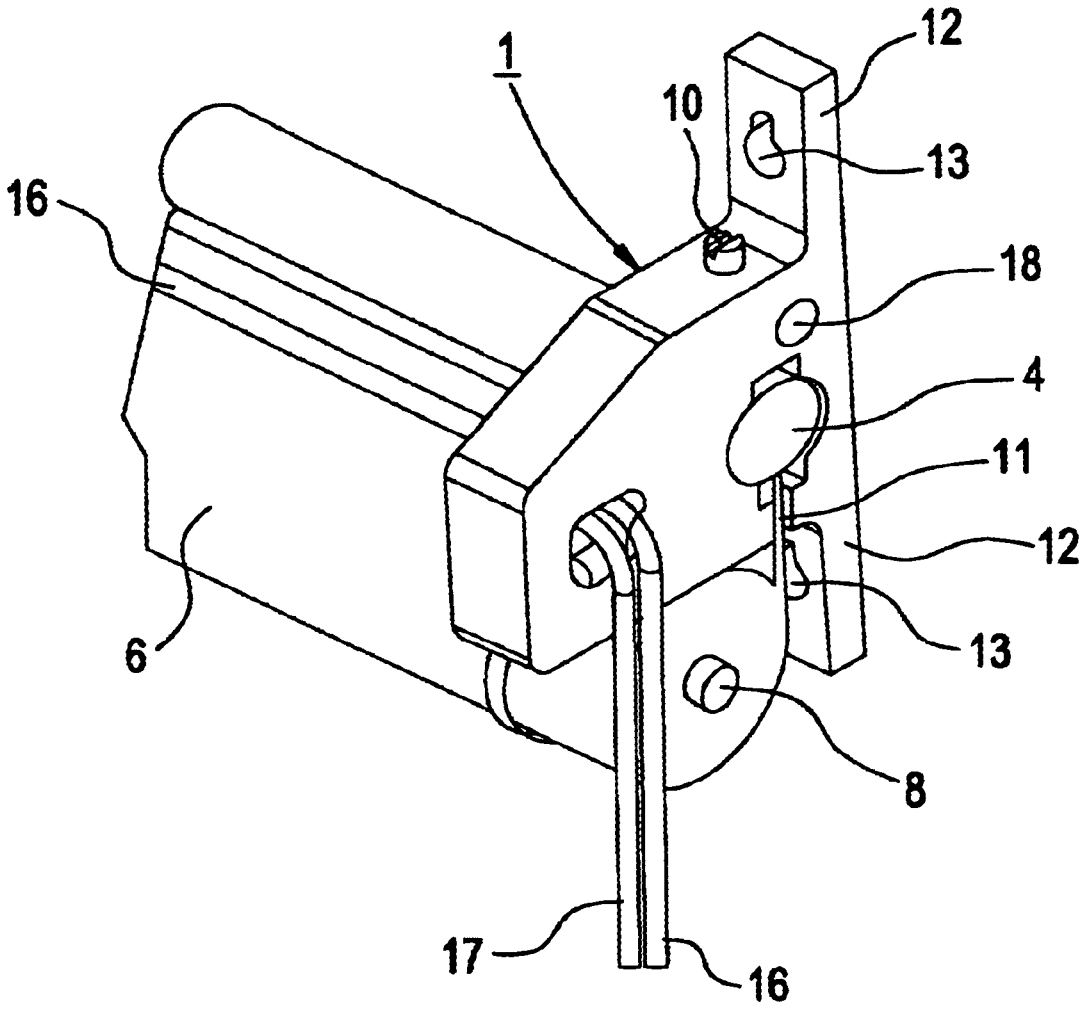
FIG. 3 is a partially cut away isometric view showing the right portion of the shade assembly of FIG. 1.
Figure 4:
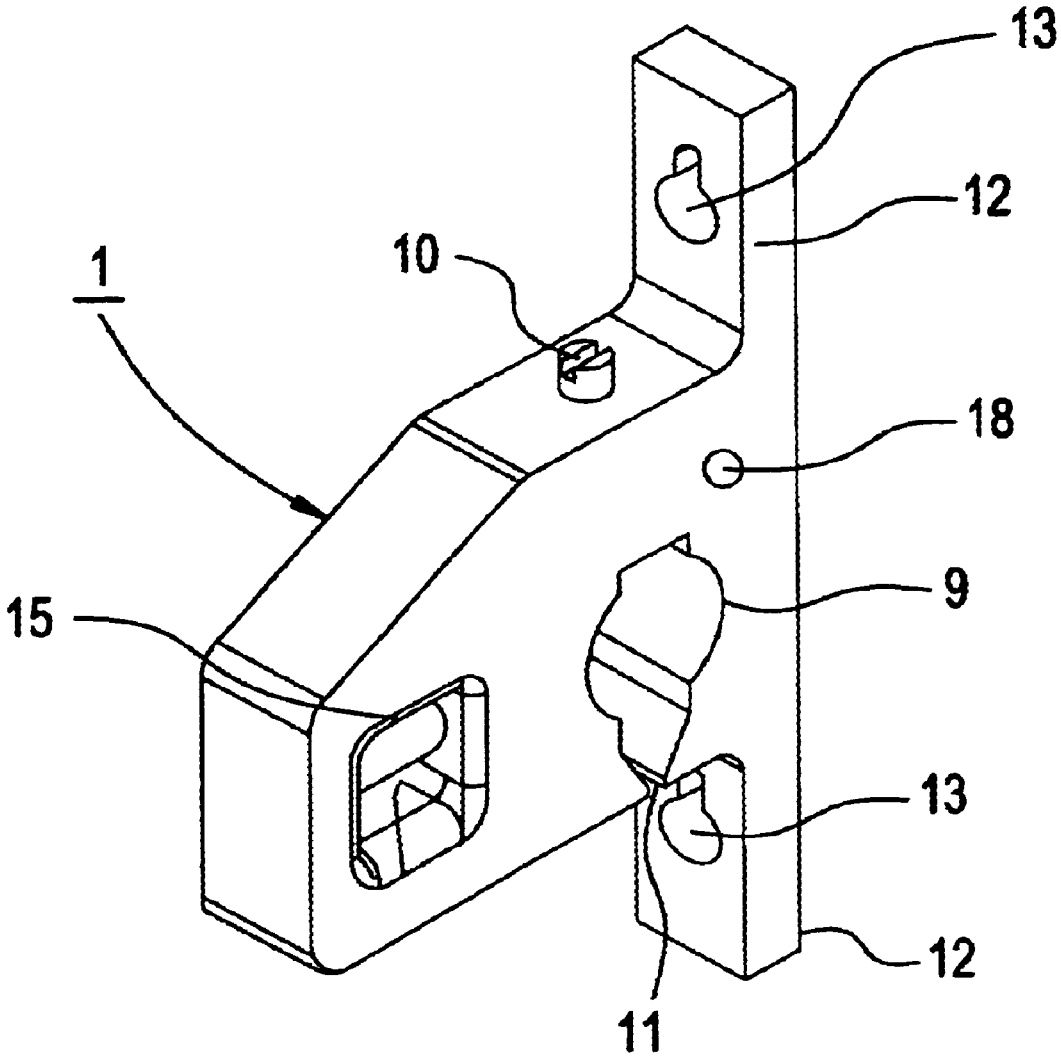
FIG. 4 is an isometric view bracket shown in FIGS. 1, 2, and 3.

Referring particularly to FIGS. 2, 3, and 4, bracket 1 can be made, for example, of molded plastic. Each bracket 1 is identical (i.e., the left bracket is the same as the right bracket), which reduces manufacturing costs. Each bracket 1 is provided with aperture 9, which can support either round rod 4 or a rectangular rod (not shown). Set screw 10 can be screwed down to hold rod 4 in place. Each bracket 1 has a channel 11, though which shade 6 passes. Each bracket 1 is also provided with two flanges 12 having key holes 13 though which screws 14 can pass to hold brackets 1 to wall 2. Each bracket 1 is further provided with a second aperture 15 though which cords 16 and/or 17 can pass. Finally, each bracket 1 is provided with a third aperture 18 through which one end of cord 16 or 17 can be passed and knotted to hold cords 16 and 17 to brackets 1 .

As shown in FIGS. 1 and 2, first cord 16 passes through aperture 15 in right bracket 1, through aperture 15 in left bracket 1, over the bottom of shade 6, and through aperture 18 in left bracket 1, where it is tied. A second cord 17 passes through aperture 16 in right bracket 1, over the bottom of shade 6, and through aperture 18 in right bracket 1, where it is tied. Pulling the other ends of cords 16 and 17 downward causes shade 6 to roll upward over rod 8 and releasing cords 16 and 17 permits shade 6 to unroll and cover window 3. (Of course, the ends of cords 16 and 17 that are pulled can also come off the left bracket by reversing "left" and "right" in the above description.) Shade 5 can be fixed at any height by tying cords 16 and 17 to cleat 19.

Where the window is wider than about 6 feet it may be desirable to use an additional bracket 1 in the middle and an additional cord mounted from that bracket in the same manner as the other two brackets.

Figure 6:
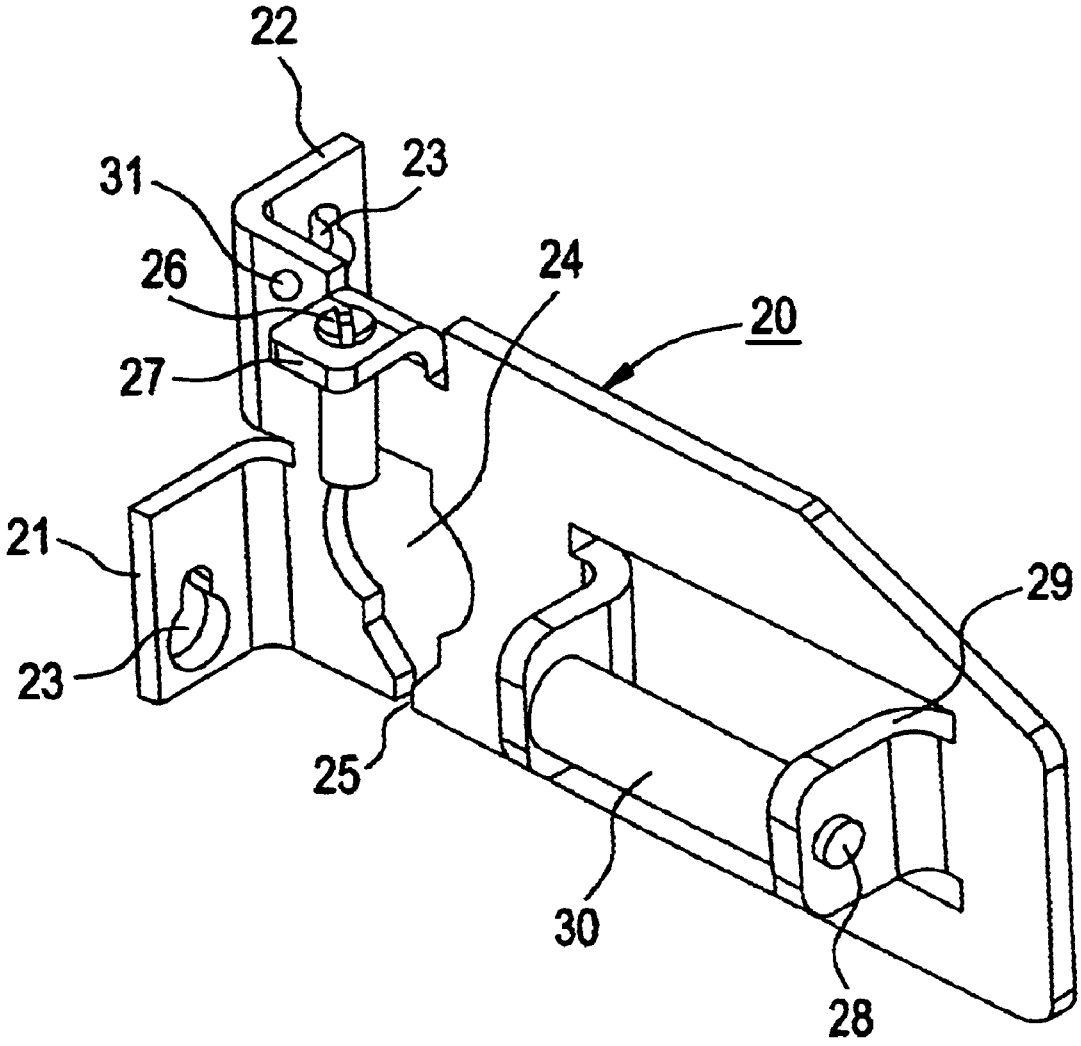
FIG. 6 is an isometric view of another embodiment of a bracket according to this invention.

In FIG. 6, an alternative bracket 20, which can be made of sheet metal, can be used as either a left bracket or a right bracket. Bracket 20 has flanges 21 and 22 each provided with key hole 23 for attaching bracket 20 to a wall (not shown). A rectangular fixed rod (not shown) or a round fixed rod (not shown) to which a shade (not shown) is attached can be inserted into aperture 24 with the shade passing through channel 25. Set screw 26 in flange 27 can hold the rod in place. Apertures 28 in flanges 29 hold a roller 30 over which can pass one or more cords (not shown). Aperture 31 can be used to secure a cord (not shown).

The brackets can be made of metal, fiberglass, plastic, or other suitable material, but are preferably made of steel or plastic. The brackets are preferably attached to the outside of a building, such as a home or office, so that the shade covers the outside of the window, but the brackets can also be used on the inside of the building. Rollers can be used to support the cords or a low friction material, such as polytetrafluoroethylene, can be used in the apertures to prevent wear on the cords. The shades can be made of any suitable material, including plastic, woven fabric, canvas, or wire or plastic screening. If desired, decorative covers or designs can be attached over the shades. Instead of tying the cords to a cleat, other means of securing the cords can be used, such as fixing the cords to a lever that is raised or lowered.

The shade can be attached to rods 4 and 8 by means other than an overlapped portion of the shade. For example, the rods can be glued to the shade, attached by Velcro, snaps, or other means. The rods can have any cross-sectional shape, including square, rectangular, circular, or elliptical.

EXAMPLE

Brackets, similar to the bracket shown in FIG. 6, were made out of sheet metal about ⅛ inch thick. The brackets were mounted on the outside of a home, on either side of four windows, in line with the top of the windows.

Awnings 5 feet long by 5 feet wide and 5 feet long by 7 feet wide were cut, overlapped at the top and bottom, and sewn to provide an opening. Metal tubes ½ inch in diameter 5 feet long, were inserted into the 5 foot openings and similar 7 foot tubes were inserted into the 7 foot openings. The set screws were tightened. A cord was tied to each bracket, looped over the bottom of the ends of the round rod, threaded through holes in the brackets (one through one bracket, the other through two brackets), tied and secured to a cleat at the side of the window.

The awnings could be easily raised and lowered to the desired height by pulling on or releasing the cords. The assemblies were left outside for over 3 years and functioned without failure during that time. The assemblies showed no signs of deterioration.

Similar assemblies were attached over the outside of two windows 5 feet long by 8 feet wide using a plain cotton material similar to blue jeans for the shade. Similar results were obtained.

What is claimed is:

1. A bracket comprising (A) a support;

(B) attaching means for attaching said support to a vertical wall, whereby said support extends out from said wall;

(C) an aperture through said support for supporting either a round rod or a rectangular rod, said aperture having the shape of a circle over which is centered a rectangle that extends beyond a portion of said circle;

(D) holding means for holding a moveable cord on said support; and (E) securing means for securing one end of a cord to said support.

2. The bracket according to claim 1 wherein said support is made of steel.

3. The bracket according to claim 1 wherein said bracket is made of plastic.

4. The bracket according to claim 1 wherein said attaching means is a flange parallel to said wall having at least one key hole therethrough.

5. The bracket according to claim 1 wherein said holding means is a pulley.

6. The bracket according to claim 1 wherein a channel extends downward through said support from said aperture.

7. The bracket according to claim 1 wherein said securing means is an aperture through said support.

8. The bracket according to claim 7 including a set screw to hold said rod in place.

9. The bracket according to claim 1 wherein said bracket can be used to support either the right end of said rod or the left end of said rod.

10. A shade assembly comprising (A) a first bracket and a second bracket, each attached to a wall at the same height on opposites sides of a window, each bracket comprising (1) a support;

(2) attaching means for attaching said support to a vertical wall, whereby said support extends out from said wall;

(3) supporting means for supporting a rod on said support;

(4) holding means for holding a moveable cord on said support; and (5) securing means for securing one end of a cord to said support;

(B) a first rod, the ends of which are supported by said supporting means of said first and second bracket;

(C) a second rod;

(D) a flexible shade, one end of which is attached to said first rod and the other end of which is attached to said second rod;

(E) a first cord that passes over the bottom of one end of said second rod and is held by said holding means of said first bracket, where one end of said first cord is secured by said securing means to said first bracket; and (F) a second cord that passes over the bottom of the other end of said second rod and is held by said holding means of said second bracket, where one end of said second cord is secured by said securing means to said second bracket.

11. The shade assembly according to claim 10 wherein said first and second rods are round.

12. The shade assembly according to claim 10 wherein said first and second rods are attached to said shade by insertion into an overlapped portion of said shade.

13. The shade assembly according to claim 10 wherein said flexible shade is made of fabric.

14. The shade assembly according to claim 10 wherein said shade assembly includes a cleat attached to said wall below one of said brackets to which the unsecured ends of said first and second cords can be attached.

15. The shade assembly according to claim 10 wherein said first bracket is identical to said second bracket.

16. The shade assembly according to claim 10 wherein said first rod is supported in the middle by a third bracket, identical to said first and second brackets.

17. The shade assembly according to claim 10 wherein said supporting means is an aperture through said support, said aperture having the shape of a circle over which is centered a rectangle that extends beyond a portion of said circle.

18. The shade assembly according to claim 17 wherein said rectangle extends beyond the top and bottom of said circle.

19. The shade assembly according to claim 10 wherein a channel extends downward through said support from said aperture.

20. A shade assembly comprising (A) a first bracket and a second bracket each attached to a wall at the same height on opposites sides of a window each bracket having a flange for attaching said bracket to a wall, supporting means for supporting a horizontal rod, holding means for holding a moving cord, and securing means for securing one end of a cord to said bracket;

(B) a first rod, the ends of which are supported by said supporting means of said first and second bracket;

(C) a second rod;

(D) a flexible shade, one end of which is attached to said first rod and the other end of which is attached to said second rod;

(E) a first cord that passes over the bottom of one end of said second rod and is held by said holding means of said first bracket, where one end of said first cord is secured by said securing means to said first bracket; and (F) a second cord that passes over the bottom of the other end of said second rod and is held by said holding means of said second bracket, where one end of said second cord is secured by said securing means to said second bracket.

* * * * *